United States Patent [19]

Witter

[11] Patent Number: 4,762,315

[45] Date of Patent: Aug. 9, 1988

[54] CHILD RESTRAINT DEVICE

[76] Inventor: Judith M. Witter, 15632 Yukon Ave., Lawndale, Calif. 90260

[21] Appl. No.: 865,766

[22] Filed: May 22, 1986

[51] Int. Cl.[4] ..... A63G 31/00; A61F 5/37

[52] U.S. Cl. ..... 272/1 R; 297/466; 128/133; 128/134

[58] Field of Search ..... 297/5, 7, 465, 466, 297/468, 487; 272/1 A, 1 B; 128/133, 134, 135; 604/366, 367

[56] References Cited

U.S. PATENT DOCUMENTS

| | | | |
|---|---|---|---|
| 16,150 | 12/1856 | Robbins | 297/5 |
| 196,730 | 10/1877 | Wick | 297/5 |
| 1,169,607 | 1/1916 | Blenis | 128/134 |
| 1,463,125 | 7/1923 | Madere | 297/468 |
| 1,538,538 | 4/1924 | Wood | 297/466 X |
| 1,837,983 | 12/1931 | Moran | 297/465 X |
| 2,486,806 | 11/1949 | Seymour et al. | 604/366 |
| 3,083,050 | 3/1963 | Gill | 297/5 |
| 3,086,529 | 4/1963 | Munz et al. | 128/134 |
| 3,196,874 | 7/1965 | Hrubecky | 604/366 |
| 3,474,781 | 10/1969 | Gaylord | 297/466 X |

*Primary Examiner*—Robert A. Hafer
*Assistant Examiner*—Samuel Rimell

[57] ABSTRACT

A child restraint device is provided for limiting the movement of a child in sand, such as at a beach or in a sandbox. The device employs a flexible sack of a size adapted to accommodate the legs and lower torso of a child. An elastic band is located at the mouth of the sack and a strip of VELCRO fastening material is secured externally about the mouth of the sack. A laterally expansive, annular apron is provided with a central opening to receive the mouth of the sack. The apron has a mating VELCRO fastening strip which encircles the central opening and which is releasably securable to the VELCRO strip at the mouth of the sack. A stiff, circular rim is provided at the outer perimeter of the apron to hold the apron extended and in an annular shape.

7 Claims, 1 Drawing Sheet

CHILD RESTRAINT DEVICE

BACKGROUND OF THE INVENTION

1. Field of the Invention

The present invention relates to an accessory for child care for use in limiting the movements of a child in a sandy environment, such as at a beach or in a sandbox.

2. Description of the Prior Art

The problem of limiting the movements of a child at the beach or in a sandbox or in some other sandy environment has long plagued parents of infants and small children. While parents greatly enjoy taking their infants and small children to a beach, this source of relaxation must be tempered by constant vigilance over the activities of a small child. Unless restrained, a child can easily walk or crawl away during even the briefest periods of distraction of the attention of the parents. This can be quite dangerous at a beach even if the edge of the water is some distance away, as infants and small children can move surprisingly rapidly toward the waterline at a beach.

For the sake of safety, many parents employ some means of limiting or restraining the movements of infants and small children in a sandy environment, such as a beach. Sometimes, the parents bring the child's stroller onto the beach and place the stroller on the sand. Alternatively, parents will sometimes transport collapsible playpens to a beach. When the playpen is errected it provides a confined area in which an infant or small child can safely remain. However, both playpens and strollers are rather bulky and difficult to transport. Both playpens and strollers require a considerable storage area, and are difficult to fit into the trunks and storage areas of automotive vehicles. Moreover, these conventional restraint devices are extremely difficult to maneuver out from automotive vehicles and onto a beach.

In a typical beach outing parents are faced with a very considerable task in transporting all the accessories and supplies needed to add comfort and relaxation to the outing. Beach blankets, beach umbrellas, picnic baskets, coolers, beach chairs and numerous other articles must be carried by hand from a vehicle parking area across the sand to a suitable location. The transportation of a baby stroller or playpen adds significantly to this burden. Furthermore, the very considerable task of moving all of the beach accessories and amenities must be performed while keeping constant watch over small infants and children.

SUMMARY OF THE INVENTION

According to the present invention, a device is provided for restraining a child in a sandy environment which is highly effective and extremely easy to transport and set up. A child restraint device according to the invention is comprised of a flexible bag suitable for enclosing or encasing the legs and lower torso of a child. The bag is closed at one end and has an open mouth at its opposite end. An elastic waistband is secured to the open mouth of the bag. The device is also provided with an expansive, flexible moisture repellant sheet, preferably of an annular configuration, which has a central opening adapted to receive the mouth of the bag. A first fastening means is located on the sheet at the central opening therein, and a second fastening means is externally located on the bag at the mouth thereof and is adapted for releasable engagement with the first fastening means. A stiff rim is secured to the periphery of the flexible sheet to hold the sheet in an expanded or extended condition with the periphery of the sheet held away from the central opening.

To use the child restraint device of the invention, the child's legs and lower torso are first placed in the bag and the bag is secured about the child's waist by means of the elastic waistband. A hole is dug in the sand, and the bag with the child therein is placed in the hole. The hole is preferably dug so that the child's waist is approximately even with the level of the sand. The annular sheet is then placed about the child so that the child's waist is located at the central opening therein. The releasable fasteners are secured together so that the child is rendered safely immobile. The expansive apron forms a very suitable surface upon which the child's playthings can be placed without danger of being lost in the sand. The apron is wide enough so that the child cannot reach beyond the rim at the periphery of the apron. This both prevents the child from losing its playthings or from gathering handfuls of sand, which a child could possibly place in its mouth. The apron forms a clean, smooth surface upon which food and baby bottles can be placed, as well as toys to amuse the child.

When a child is placed in the child restraint device of the invention, the weight and resistance of the sand on the exterior of the sack or bag in which the child's legs are located prevents the child from crawling away unnoticed. The expansive apron with the stiff rim thereon both aids in preventing the child from working its legs free from the sand, and provides a clean play surface where even foods and liquids will not become gritty and dirty from contact with sand.

Preferably, the annular apron is split radially so that the size of the central opening therein can be increased or reduced, depending upon the girth of the child's waist.

By fitting the apron snugly about the mouth of the sack, one is able to ensure that the means used to fasten the apron about the waist of the child is snug and secure. Also, when the edges of the apron defining the central opening therein are pulled snugly about the waist of the child, the likelihood that sand will work onto the apron through an interstitial space between the apron and the mouth of the sack is minimized.

Preferably, the sack is formed of a plurality of layers of flexible plastic or fabric material. The bag or sack may be formed of an exterior layer of moisture impervious material, such as polyvinyl chloride or some other moisture repellant plastic, and an interior layer of some soft absorbent material, such as cotton. By forming the sack in this manner, the external plastic layer keeps water, sand and insects out of the sack. The softer, more absorbent interior layer absorbs perspiration and helps prevent the child's legs from becoming chilly due to their location beneath the surface of the surrounding sand. The child's legs and lower torso thereby remain comfortable within the sack.

The apron is also preferably formed of a moisture resistant or repellant material, such as vinyl plastic. The expanse of the apron is wide enough so that even a child leaning toward the surrounding rim will not be able to reach the sand and dig into it. It is thus possible to provide the child with food and beverages without fear that the child will get his or her hands dirty or gritty and place them in his or her mouth. Food, such as cookies and crackers, and beverages in containers such as baby bottles with nipples can be placed upon the apron without fear of contamination, since the child cannot reach the surrounding sand to place sand upon the apron.

Preferably also, the stiff, encircling rim is provided with some form of decoration or amusement, such as wooden or plastic spheres mounted for rotation upon axles at notches or grooves in the annular rim. Infants and small children can thus spin the rotatable spheres provided for this pupose.

A very significant advantage of the present invention over prior child restraint devices used in sandy environments is that the child restraint device of the invention can be collapsed into a very compact and extremely light-weight package. The sack and the apron are formed of flexible, machine washable materials, and can be folded or packed easily into a purse or baby bag. The rim at the perimeter of the apron is preferably a light-weight stiff, but not overly rigid plastic, such as polyvinyl chloride. The rim can be either permanently or releasably attached to the apron. With either construction, the rim can be carried lightly under one's arm or hung about one's neck for easy transport to and from an automotive vehicle.

As previously noted, the peripheral rim of the child restraint device of the invention is preferably split and first and second releasable fastening elements are located at the ends of the rim at the split. These releasable fastening elements preferably take the form of flat, mating pads, at least one of which is mounted on a short strap. One pad in each set of mating pads bears a multiplicity of minute flexible hooks, and the other of the pads in the set bears a pile having a multiplicity of minute loops that are releasably engagable by the hooks. Such fastening elements are widely available under the registered trademark velcro. To secure the rim in an annular configuration, the apron is first positioned about the waist of the child. The fastening means between the mouth of the sack and the center of the apron are releasably secured, and the ends of the split ring are also releasably secured together using the mating velcro strips.

The fastening means employed to secure the apron about the waist of the child are also preferably formed of a set of strips bearing mating velcro pads.

One of these mating pads is sewn or glued on the exterior surface of the sack to extend entirely around the circumference thereof at the mouth of the sack. The other mating element is secured to the radially interior edge of the apron which defines the central opening therein. One light pressure is required to press the strips of mating velcro pads together so as to securely, but releaseably engage the apron about the mouth of the sack.

The invention may be described with greater clarity and particularity by reference to the accompanying drawing.

DESCRIPTION OF THE EMBODIMENT

Figure 2:
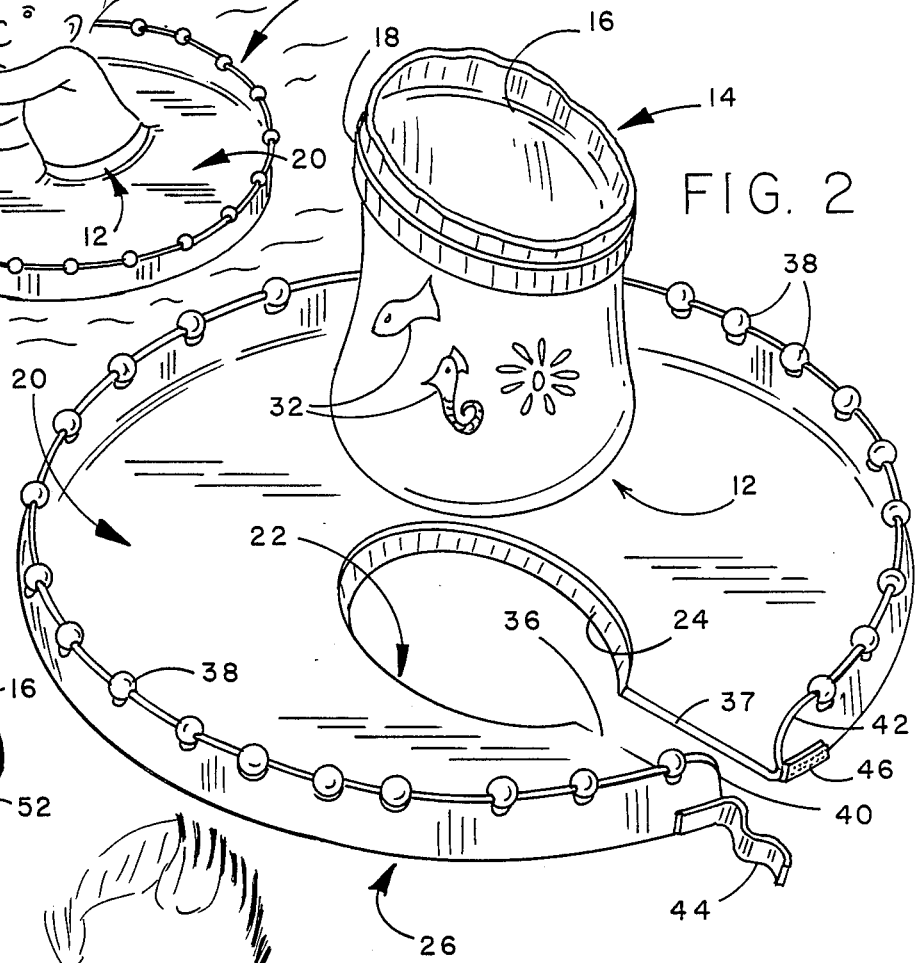
FIG. 2 is a perspective view showing the parts of the child restraint device of FIG. 1 separated from each other.
Figure 3:
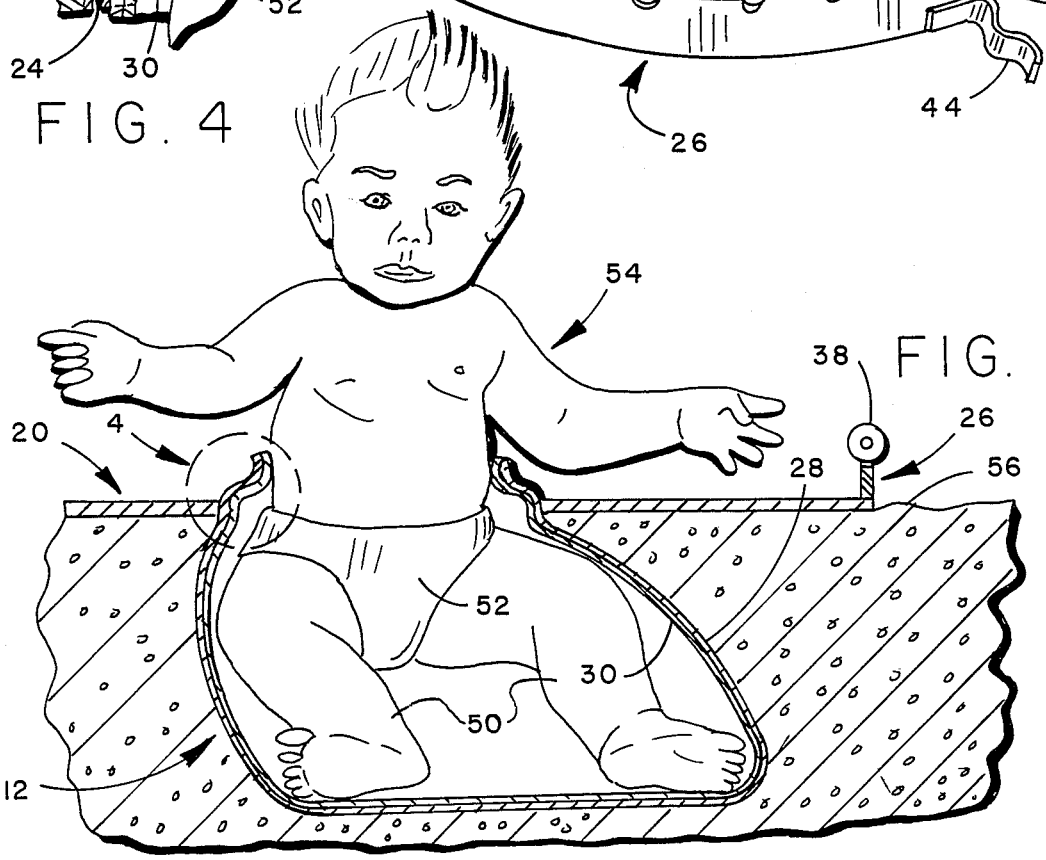
FIG. 3 is a sectional elevational view illustrating the manner of use of the child restraint device of FIG. 1.

A child restraint device 10, according to the invention is depicted in the drawings. As best illustrated in FIG. 2, the child restraint device 10 is comprised of a flexible sack 12 adapted to accommodate the legs and lower torso of a child, as depicted in FIG. 3. The sack 12 has a mouth 14 with an elastic band 16 extending thereabout. The sack 12 has a first fastening means 18, in the form of one of a pair of mating velcro strips. The strip 18 is secured to the exterior of the structure of the sack 12 and encircles the mouth 14 thereof. The child restraint device 10 also includes a laterally expansive, annular sheet forming an apron 20, constructed of moisture repellant material. The apron 20 has a central opening 22 therein an is adapted to receive the mouth 14 of the bag or sack 12. A second fastening means 24, in the form of another velcro strip which mates with the velcro strip 18, is secured about the inner perimeter of the edge of the apron 20 which defines the central opening 22. A stiff, annular rim 26 is secured to the outer perimeter of the apron 20 and maintains the apron 20 in a stretched, annular shape with the periphery of the apron so held away from the central opening 22.

Figure 4:
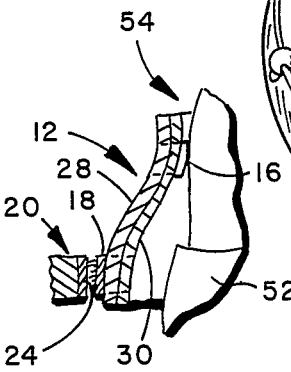
FIG. 4 is a sectional elevational detail indicated at 4 in FIG. 3.

As best illustrated in FIGS. 3 and 4, the sack 12 is formed of an exterior layer 28 of moisture impervious or resistant material, such as a flexible sheet of polyvinyl chloride, and an interior layer 30 of a soft absorbent material, preferably a sheet of cotton. The moisture impervious layer 28 serves to keep water, sand and insects out of the sack 12, while the absorbent cotton layer 30 ensures that the child is comfortable by absorbing perspiration and by providing insulation to prevent the child's legs from becoming cold. The layers 28 and 30 may be secured throughout their interface, or sewn together only at the mouth 14 of the sack 12. Preferably, small cartoon figures such as pictures of animals or sea creatures, indicated at 32 in FIG. 2, are printed on the external layer 28 both for decoration, and to create a positive attitude on the part of the child placed in the child restraint device 10.

The first fastening strip 18 which encircles the mouth 14 of the sack 12 is preferably an elongated strip of female velcro pad material which bears a pile and has a multiplicity of minute loops. The second means 24 is preferably an elongated strip of a mating velcro pad which bears a multiplicity of minute, flexible hooks which are engagable in the pile of the strip 18. The mating velcro strips 18 and 24 are releasably secured together as depicted in FIGS. 3 and 4 by only light contact, and can be easily peeled away from each other.

The apron 20 is radially split to form facing edges 36 and 37 which extend from the central opening 22 outwardly to the encircling rim 26. The distance between the central opening 22 and the peripheral rim 26 is sufficiently great so that the child cannot reach beyond the rim 26 to grasp sand. The apron 20 thereby provides a smooth, clean surface upon which the child can receive food and beverages without danger of contamination. Also, the surface of the apron 20 forms an excellent surface upon which the infant can play with toys. As illustrated, the peripheral rim 26 is preferably formed of a stiff, upstanding plastic and has notches or grooves therein within which a plurality of spheres 38 are mounted. A younster placed in the child restraint device 10 can find amusement by reaching the spheres 38 and spinning them within the grooves defined in the rim 26.

The rim 26 is formed as a split ring having facing edges 40 and 42. The rim 26 is also equipped with a releasable latching means formed by first and second releasable elements 44 and 46 respectively. The releasable element 44 is a short strap secured at one end proximate to the edge 40 of the rim 26, and having an opposite free end bearing one of a pair of mating velcro pads. The releasable element 46 is formed by a corresponding, mating pad securely mounted on the outer surface of the rim 26 adjacent to the edge 42. The velcro pad on one of the releasable elements 44 and 46 bears a multiplicity of minute flexible hooks, and the other of the pads on the second of the releasable elements 44 and 46 bears a pile having a multiplicity of minute loops engageable by the hooks on the opposite pad. To secure the latching means of the invention together and to close the rim 26 into a circular ring, the free end of the strap 44 is merely placed in contact with the pad 46. Securing the latching mechanism brings the abutting edges 36 and 37 of the apron 20 together as well.

Figure 1:
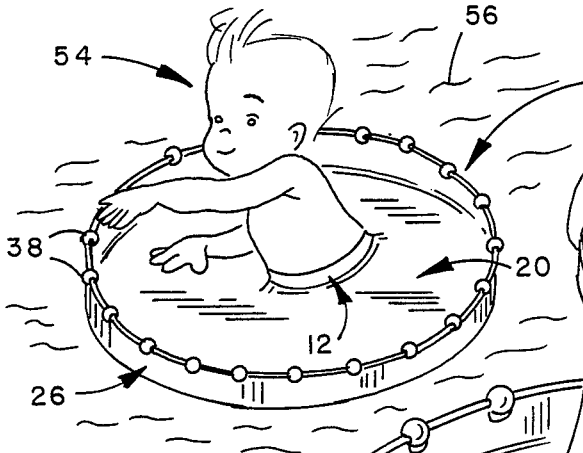
FIG. 1 is a perspective view showing the use of the child restraint device of the invention.

To utilize the child restraint device 10, the sack 12 is first separated from the apron 20 and the rim 26 as depicted in FIG. 2. The legs 50 and lower torso 52 of an infant or small child 54 are then placed within the confines of the sack 12. The elastic band 16 is stretched to admit the legs 50 and lower torso 52 of the child to the sack 12. When the elastic band 16 is released, it remains snugly secured about the waist of the child, as depicted in FIGS. 1 and 3.

A hole is dug in the sand 56 to a depth such that when the child 54 is seated in the hole in the sand, its waist will be at approximately the same level as the upper surface of the sand 56, as best depicted in FIG. 3. The apron 20 is then placed about the waist of the child 54 by drawing apart the edges 36 and 37 thereof so that the apron 20 can be properly positioned. The apron 20 is positioned about the child with the child's waist at the central opening 22 therein, and with the edges 36 and 37 radiating from the child's waist, preferably, at the child's back. By positioning the unsecured seam formed by the edges 36 and 37 at the child's back, the child is unable to dig in the sand between the abutting edges 36 and 37. The mating fastening strips 18 and 24 are pressed together to releasably engage the apron 20 to the mouth 14 of the sack 12. The strap 44 is pressed against the pad 46 to releasably secure the latching mechanism of the rim 26 so that the apron 20 remains snugly secured about the child's waist.

Once the child 54 has been seated in the hole in the sand 56, the sand about the hole will tend to collapse onto the sack 12, thus preventing the child 54 from crawling away. The child is thus safely restrained and can happily play with toys on the upper surface of the apron 20.

The apron 20 and the sack 12 are both constructed of machine washable fabric and plastic and can be readily folded in an extremely compact fashion for ease of transport. The rim 26 is also extremely light in weight and can be carried with little difficulty.

Undoubtedly, numerous variations and modifications of the invention will become readily apparent to those familiar with child restraint devices and accessories. Accordingly, the scope of the invention should not be construed as limited to the specific embodiment depicted and described, but rather is defined in the claims appended hereto.

I claim:

1. A child restraint device which can be buried in the sand to a predetermined level, comprising a flexible sack of a size adapted to accommodate the legs and lower torso of a child and having a mouth with an elastic band extending thereabout and having first fastening means thereat, a laterally expansive, apron defining a central opening and a periphery remote therefrom and having second fastening means at said central opening releaseably interengageable with said first fastening means and a stiff rim at the outer perimeter of said apron for maintaining said apron in an expanded condition with said periphery held away from said central opening, said annular apron and said rim being radially split, and said rim being equipped with releasable latching means where it is split so that said central opening is adjustable.

2. A child restraint device according to claim 1 wherein said releasable latching means is comprised of first and second releasable elements, located on opposite sides of the split in said rim, wherein said first and second releasable elements are comprised of sets of flat, mating pads, and in each set one of said mating pads bears a multiplicity of minute, flexible hooks and the other of said pads bears a pile having a multiplicity of minute loops releasably engageable by said hooks.

3. A child restraint device according to claim 1 wherein one of said first and second fastening means is comprised of a pad bearing a multiplicity of minute, flexible hooks and the other of said first and second fastening means is comprised of a pad bearing a pile having a multiplicity of minute loops releasably engageable by said hooks.

4. A device for restraining a child comprising a flexible bag suitable for enclosing the legs and lower torso of a child, closed at one end and having an open mouth at an opposite end, an elastic waistband secured to said open mouth of said bag, an expansive, flexible, moisture repellant sheet having a central opening therein adapted to receive said mouth of said bag, first fastening means located on said bag at said open mouth, second fastening means located on said sheet at said central opening and adapted for releasable engagement with said first fastening means, a stiff rim secured to the periphery of said flexible sheet for holding said sheet in an extended condition, said rim being shaped in the form of a split ring having releasable latching means for joining the ends of said split ring and said sheet is radially split from said central opening to the split in said ring.

5. A device according to claim 4 wherein said first and second fastening means are comprised of a set of strips bearing mating pads and one of said mating pads has a multiplicity of minute, flexible hooks and the other of said mating pads has a multiplicity of minute loops engageable by said hooks.

6. A device according to claim 4 wherein said bag is formed of an exterior layer of moisture impervious material and an interior layer of soft, moisture absorbent material.

7. A device according to claim 6 wherein said exterior layer is formed of vinyl and said interior layer is formed of cotton.

* * * * *